US011476584B2

(12) United States Patent
Cox et al.

(10) Patent No.: US 11,476,584 B2
(45) Date of Patent: Oct. 18, 2022

(54) GENERAL AVIATION DUAL FUNCTION ANTENNA

(71) Applicant: R.A. Miller Industries, Inc., Grand Haven, MI (US)

(72) Inventors: Roger Cox, Spring Lake, MI (US); Matthew Steven Tuin, West Olive, MI (US)

(73) Assignee: R.A. Miller Industries, Inc., Grand Haven, MI (US)

( * ) Notice: Subject to any disclaimer, the term of this patent is extended or adjusted under 35 U.S.C. 154(b) by 777 days.

(21) Appl. No.: 15/680,399

(22) Filed: Aug. 18, 2017

(65) Prior Publication Data

US 2018/0054002 A1 Feb. 22, 2018

Related U.S. Application Data

(60) Provisional application No. 62/376,450, filed on Aug. 18, 2016.

(51) Int. Cl.

| | |
|---|---|
| ***H01Q 9/30*** | (2006.01) |
| ***H01Q 9/32*** | (2006.01) |
| ***H01Q 1/12*** | (2006.01) |
| ***H01Q 1/32*** | (2006.01) |
| ***H01Q 1/42*** | (2006.01) |
| ***H01Q 9/04*** | (2006.01) |
| ***H01Q 21/28*** | (2006.01) |
| *H01Q 1/28* | (2006.01) |

(52) U.S. Cl.

CPC ..... *H01Q 9/30* (2013.01); *H01Q 1/1214* (2013.01); *H01Q 1/3275* (2013.01); *H01Q 1/42* (2013.01); *H01Q 9/0407* (2013.01); *H01Q 9/32* (2013.01); *H01Q 21/28* (2013.01); *H01Q 1/28* (2013.01)

(58) Field of Classification Search

CPC ..... H01Q 9/30; H01Q 1/1214; H01Q 1/3275; H01Q 1/42; H01Q 9/0407; H01Q 9/32; H01Q 21/28; H01Q 1/50; H01Q 1/48; H01Q 3/34; H01Q 21/065; H01Q 21/0075; H01Q 3/40; H01Q 1/38; H01Q 21/0006; H01Q 3/30; H01Q 21/061; H01Q 1/28; H01P 3/081; H01P 3/088

See application file for complete search history.

(56) References Cited

U.S. PATENT DOCUMENTS 4,342,037 A * 7/1982 Dalby ..... H01Q 1/528 343/830
4,509,056 A * 4/1985 Ploussios ..... H01Q 9/16 343/791
4,730,195 A * 3/1988 Phillips ..... H01Q 9/18 343/822
4,821,040 A * 4/1989 Johnson ..... H01Q 1/3275 343/700 MS (Continued)

*Primary Examiner* — Dimary S Lopez Cruz
*Assistant Examiner* — Bamidele A Jegede
(74) *Attorney, Agent, or Firm* — McGarry Bair PC

(57) ABSTRACT

An apparatus for an antenna assembly, which can be used for a mobile application such as on an aircraft, can include a housing defining an interior. A first antenna, such as a WAAS GPS antenna, can mount within the interior to operate at a first frequency. A second antenna, such as an L-band monopole antenna, can mount within the interior of the housing. A trap coupled to the second antenna can be tuned to the first frequency to prevent signal loss caused by the second antenna.

17 Claims, 9 Drawing Sheets

(56) References Cited

U.S. PATENT DOCUMENTS 5,610,620 A * 3/1997 Stites ..... H01Q 23/00 343/722
5,877,725 A * 3/1999 Kalafus ..... G01S 19/071 342/357.44
6,078,295 A * 6/2000 Rawle ..... H01Q 9/32 343/792
6,150,984 A * 11/2000 Suguro ..... H01Q 1/242 343/700 MS
6,229,488 B1 * 5/2001 Lin ..... H01Q 1/242 343/700 MS
6,298,243 B1 * 10/2001 Basile ..... H01Q 9/32 455/562.1
6,469,663 B1 * 10/2002 Whitehead ..... G01S 19/44 342/357.31
6,734,828 B2 * 5/2004 Shor ..... H01Q 5/00 343/700 MS
7,786,937 B1 * 8/2010 Stierhoff ..... H01Q 21/28 343/705
7,853,324 B2 * 12/2010 Stevenson ..... H03H 1/0007 607/2
8,244,370 B2 * 8/2012 Halperin ..... G01R 33/285 600/377
8,319,693 B2 * 11/2012 Chakam ..... H01Q 1/3291 343/713
9,601,824 B2 * 3/2017 Apaydin ..... G04G 21/04
2005/0156796 A1 * 7/2005 Nysen ..... H01Q 1/2275 343/702
2006/0227061 A1 * 10/2006 Littlefield ..... H01Q 9/20 343/792
2007/0040757 A1 * 2/2007 Blickle ..... H01Q 1/1214 343/713
2007/0171138 A1 * 7/2007 Noro ..... H01Q 1/1214 343/700 MS
2008/0055171 A1 * 3/2008 Noro ..... H01Q 1/1214 343/715
2008/0117111 A1 * 5/2008 Ikeda ..... H01Q 1/1214 343/713
2009/0207084 A1 * 8/2009 Ikeda ..... H01Q 1/1207 343/713
2010/0117912 A1 * 5/2010 Noro ..... H01Q 1/3275 343/713
2011/0221640 A1 * 9/2011 Huber ..... H01Q 1/1214 343/713
2012/0154236 A1 * 6/2012 Apostolos ..... H01P 3/08 333/204
2016/0118720 A1 * 4/2016 Kim ..... H01Q 15/0086 343/700 MS
2016/0225268 A1 * 8/2016 DeBusk ..... H01Q 21/30
2017/0077594 A1 * 3/2017 Sugimoto ..... H01Q 1/3275
2018/0069326 A1 * 3/2018 Van Gils ..... H01Q 21/28

* cited by examiner

GENERAL AVIATION DUAL FUNCTION ANTENNA

CROSS-REFERENCE TO RELATED APPLICATION

This application claims priority to U.S. Provisional Patent Application No. 62/376,450, filed Aug. 18, 2016, which is incorporated herein by reference in its entirety.

BACKGROUND OF THE INVENTION

Mobile vehicles, and particularly aircraft, often utilize a global positioning system (GPS) as well as a transponder for transmitting and receiving wireless signals, such as for identification purposes. Often, a GPS will operate at a frequency that is near or overlapping with a frequency for the transponder, operating at high powers. Therefore, it is typically necessary to physically separate the GPS from the transponder to prevent any interference caused between the two.

BRIEF DESCRIPTION OF THE INVENTION

In one aspect, the disclosure relates to an antenna assembly for an aircraft including a housing defining an interior and including a bottom forming a ground plate. A WAAS GPS antenna mounts within the interior and operates at a first frequency. An L-band monopole antenna also mounts within the interior of the housing and extends from the ground plane. A trap is coupled to the L-band monopole antenna and is tuned to the first frequency of the WAAS GPS antenna. The trap operates to prevent the L-band monopole antenna from affecting the gain and radiation patterns of the WAAS GPS antenna at the first frequency.

In another aspect, the present disclosure relates to an antenna assembly for an aircraft comprising a housing defining an interior. A first antenna mounts within the interior and operates at a first frequency. A second antenna mounts within the interior of the housing and extends from the ground plane. A trap couples to the second antenna and is tuned to the first frequency of the first antenna. The trap operates to prevent the second antenna from affecting the gain and radiation patterns of the first antenna at the first frequency.

In yet another aspect, the present disclosure relates to a dual function antenna comprising a WAAS GPS antenna and an L-band monopole antenna coupled to a common ground plate. A trap couples to the L-band monopole antenna to prevent the L-band monopole antenna from affecting the gain and radiation patterns of the WAAS GPS antenna.

DETAILED DESCRIPTION OF THE INVENTION

Aspects of the disclosure described herein are directed to a dual function antenna having a GPS antenna and a monopole antenna provided in a single housing. A trap formed on the monopole antenna can prevent signal interruption of the GPS that might otherwise be caused by the monopole antenna. For purposes of illustration, the present disclosure will be described with respect to a dual function antenna for an aircraft implementation, such as affixed along the exterior of an aircraft. It will be understood, however, that aspects of the disclosure described herein are not so limited and may have general applicability in any mobile or non-mobile application where antenna communication is desirable, as well as in non-aircraft applications, such as other mobile applications and non-mobile industrial, commercial, and residential applications.

Figure 1:
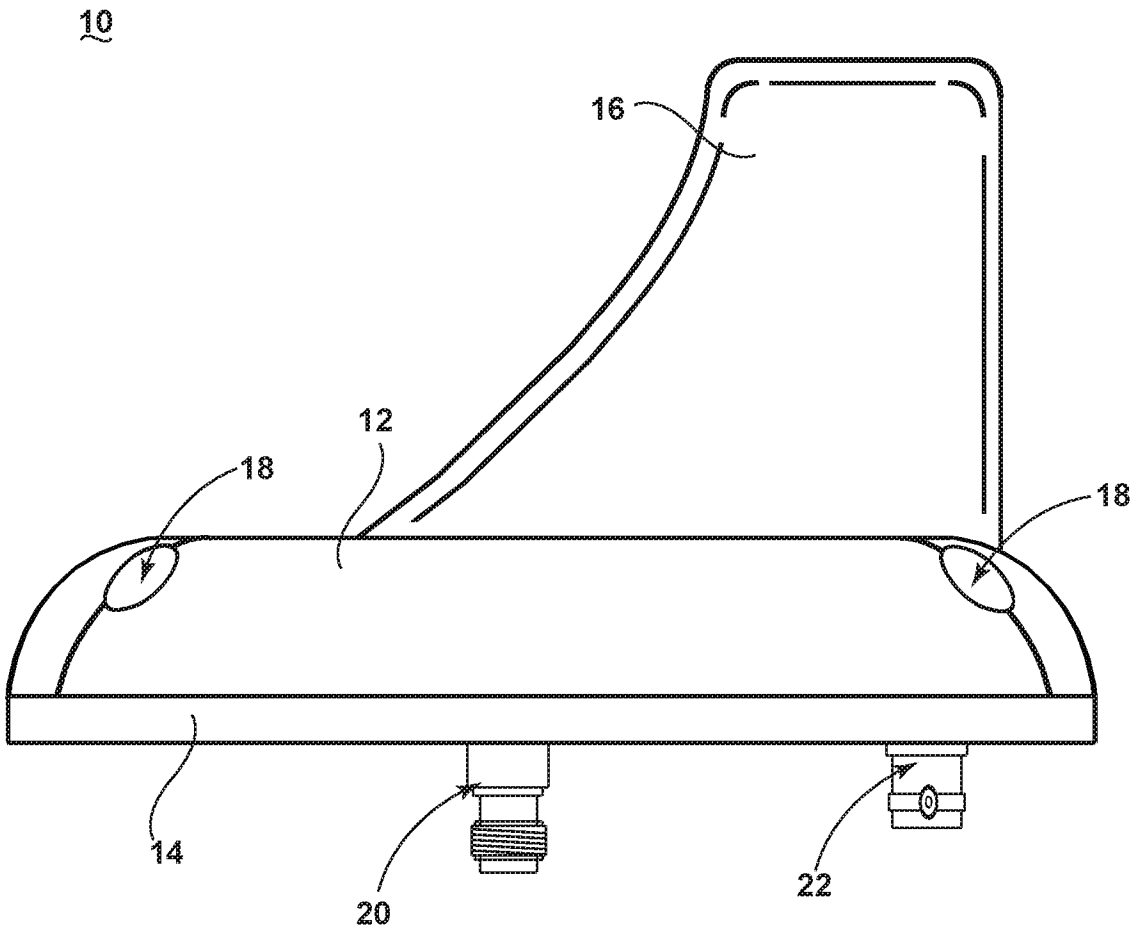
FIG. 1 is a side view of a dual function antenna assembly having a housing and a ground plate coupled to the housing.

Referring now to FIG. 1, an antenna assembly 10 includes a housing 12 coupled to a base plate 14. The housing 12 can be made of plastic or polymeric materials, suitable to house electrical components while having minimal or no impact on a wireless signal passing through the housing 12. The base plate 14 can be a ground plate, for example, forming a ground plane for an antenna extending within the housing 12. In one non-limiting example, the base plate 14 can be formed of aluminum. In one further example, the base plate 14 can be formed with the same material as an aircraft to which the antenna assembly affixes, extending the ground plane formed by the ground plate along the exterior surface of the aircraft. The housing 12 can include a rounded, aerodynamic shape adapted to minimize drag across the antenna assembly 10.

A fin 16 extends from the housing 12 opposite of the base plate 14. The fin 16 can have a height suitable to house an antenna, such as a monopole antenna, extending orthogonal to the base plate 14 within the housing 12. The housing 12 can further include a set of apertures 18 adapted to receive inserted fasteners to fasten the housing 12 to the base plate 14. The fin 16 can include a curved and rounded shape, adapted to minimize aerodynamic drag across the fin 16.

A first connector 20 and a second connector 22 can extend from the base plate 14. The first connector 20, for example, can be a female Threaded Neill-Concelman (TNC) connector adapted to couple to a global positioning system (GPS) antenna within the housing 12, while any suitable connector is contemplated. The second connector 22 can be female Bayonet Neill-Concelman (BNC) connector, for example, adapted to couple to a monopole antenna within the housing 12, while any suitable connector is contemplated. While the first and second connectors 20, 22 are shown as female connectors, it should be understood that any suitable male or female connector is contemplated. The first and second connectors 20, 22 couple to the base plate 14 to functionally couple to two antennas within the housing 12.

Figure 2:
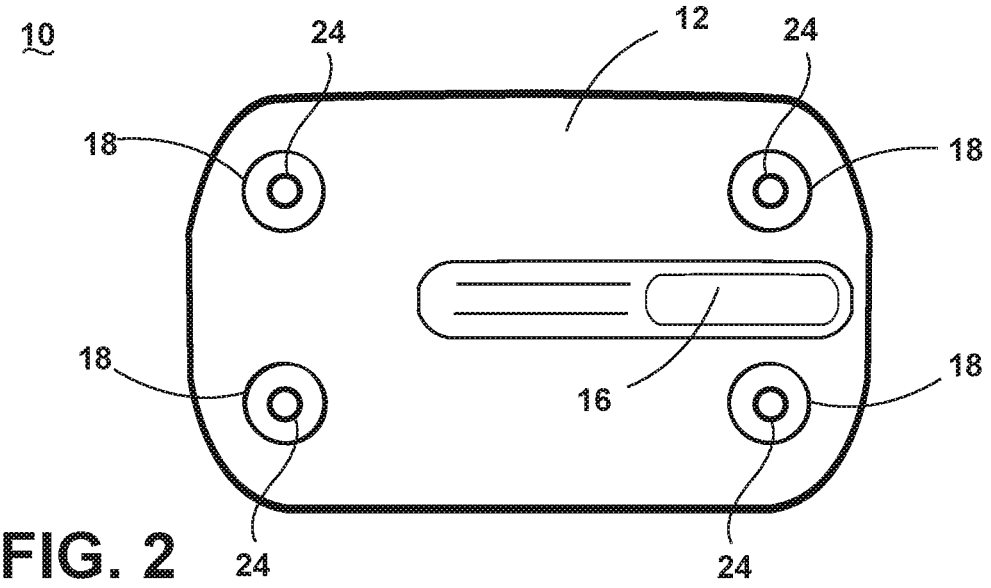
FIG. 2 is a top view of the housing of FIG. 2.

Referring now to FIG. 2, the housing 12 includes four apertures 18, each aperture having a first fastener hole 24 extending through the housing 12, adapted to receive a fastener to affix the housing 12 to the base plate 14 and to a mount surface for the antenna assembly 10, such as the exterior of an aircraft. Suitable fasteners for coupling the housing 12 can include screws in one non-limiting example.

Figure 3:
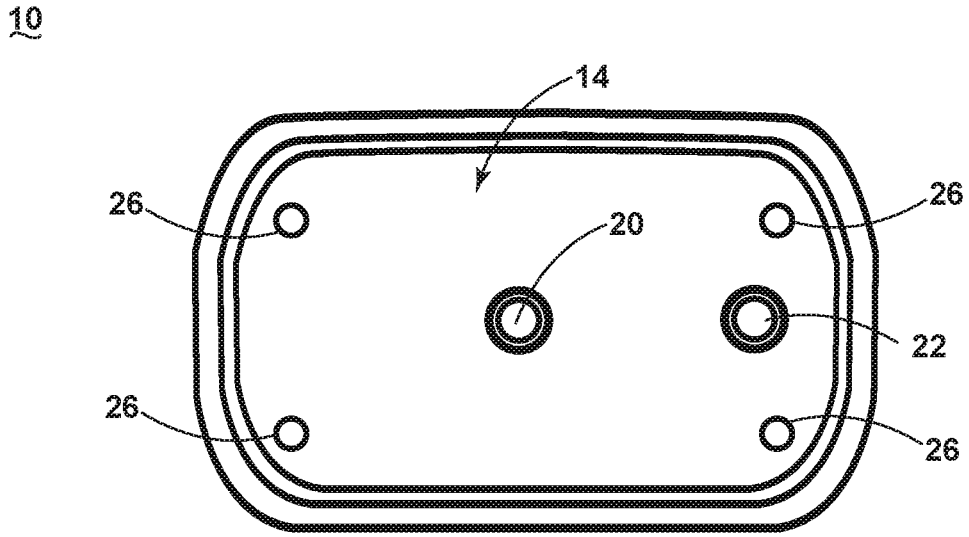
FIG. 3 is a bottom view of the ground plate of FIG. 1

Referring now to FIG. 3, a set of second fastener holes 26 are provided in the base plate 14, complementary to the first fastener holes 24 in the housing 12 of FIG. 2. The set of second fastener holes 26 can align with the first fastener holes 24 to facilitate mounting of the antenna assembly 10 to a structure or aircraft. Additionally, the first and second connector 20, 22 extend from the base plate 14. In a mounted position, the structure or aircraft can have apertures or holes adapted to receive the first and second connectors 20, 22.

Figure 4:
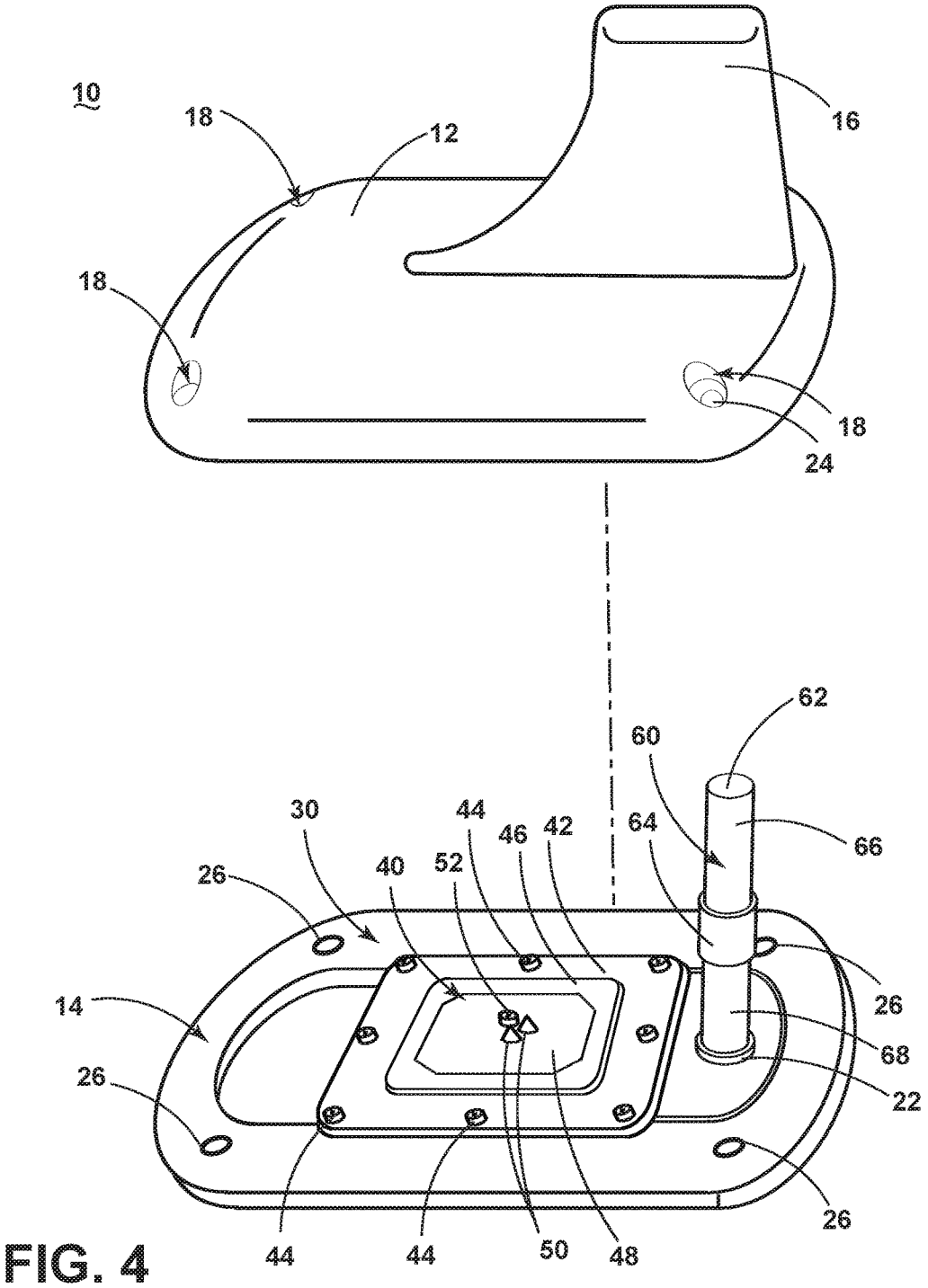
FIG. 4 is an exploded view of the dual function antenna assembly of FIG. 1 having a housing separated from a ground plate, with an exemplary GPS antenna and a monopole antenna extending from the ground plate having a trap.

Referring now to FIG. 4, the housing 12 has been exploded from the base plate 14 exposing an interior 30 of the antenna assembly 10. The housing 12 can be hollow such that the interior 30 is formed within the housing 12 and enclosed by the base plate 14 in the assembled position, such as that of FIG. 1.

A first antenna 40 is provided within the interior 30 attached to the base plate 14, positioned substantially in the center of the base plate 14, while any suitable position is contemplated. The first antenna 40 can be a global positioning system (GPS) antenna, such as for radio navigation, while any suitable global navigation satellite system (GNSS) or other suitable positioning system is contemplated. The first antenna 40 is illustrated as a ceramic patch-type antenna, while any suitable antenna is contemplated, such as a helical antenna in one non-limiting example. The first antenna 40 can include a first plate 42 fastened to the base plate 14 with a set of fasteners 44. The first plate 42 can form another ground plane coupled to the base plate 14 to ground the first antenna 40. A dielectric substrate 46 can support a microstrip patch portion 48 having a set of antenna probes 50 and another fastener 52. The dielectric substrate 46 can be any suitable dielectric substrate or can be an insulator based upon the particular implementation of the first antenna 40. In one example, the dielectric substrate 46 can be ceramic. The patch portion 48 with the antenna probes 50 can provide for a hemispherical radiation pattern for the first antenna 40.

The first antenna 40 can operate at a frequency of about 1575 MHz (megahertz), such as 1575.42 MHz+/−10.23 MHz, while a wider operational range is contemplated, such as +/−100 MHz in one non-limiting example. The first antenna 40 can operate at a voltage standing wave ratio (VSWR) of less than 2:1, of voltage to frequency, and can have a VSWR of 1.5 in one non-limiting example.

A second antenna 60 can be an L-band monopole antenna, while other suitable antennas are contemplated. The second antenna 60 can be sized to fit within the interior of the fin 16, and can extend to define a longitudinal length for the second antenna 60. The second antenna 60 can include a monopole antenna 62 connected to the second connector 22. In one example, the monopole antenna 62 can be formed from brass and be silver plated. The monopole antenna 62 can operate as one or more of a transponder, an automatic dependent surveillance-broadcast (ADS-B), or a distance measuring equipment (DME) transponder, suitable for location, positioning, and other similar communication services, and can have an omnidirectional radiation pattern. The second antenna 60 can operate along a frequency range from 960-1220 MHz, while wider ranges or alternative ranges are contemplated. The second antenna can operate at a VSWR that is 2:1 or less in the 960-1220 frequency range.

A trap 64 can couple to the monopole antenna 62, to separate the monopole antenna into an upper portion 66 and a lower portion 68. The trap 64 is a parallel-tuned tank circuit that effectively acts as an open circuit at resonance. The total impedance of a circuit is infinite and behaves as an open circuit at resonance. This can be tuned to the frequency of the first antenna 40.

Figure 5:
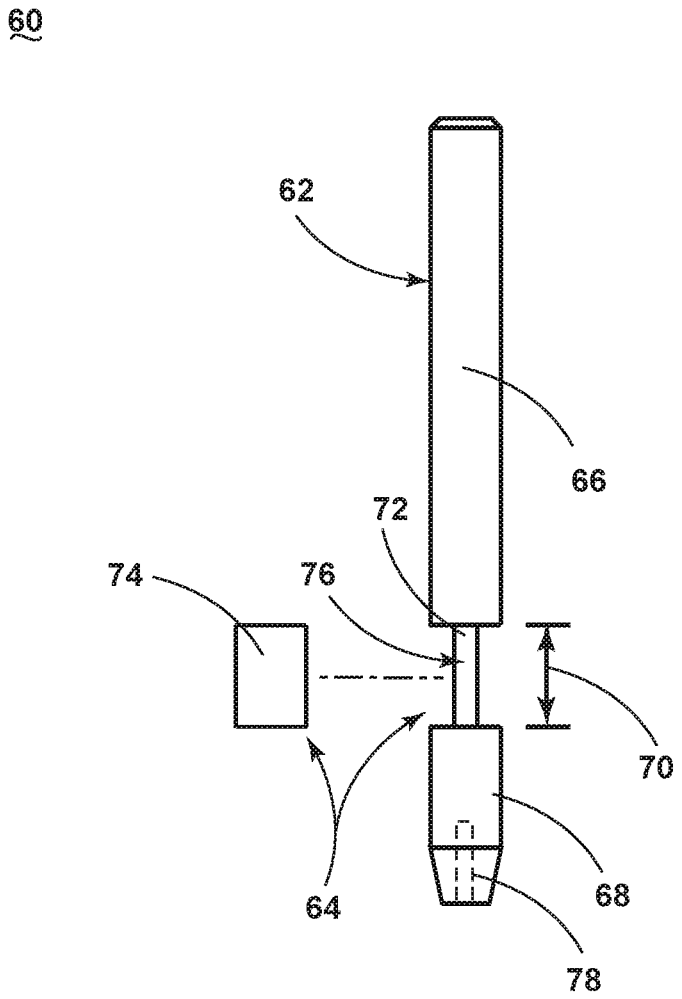
FIG. 5 is an isolated view of the monopole antenna of FIG. 4, having a capacitor exploded from the monopole antenna and the trap.

Referring now to FIG. 5, the monopole antenna 62 includes the upper portion 66 spaced from the lower portion 68 to define a gap 70. A small-diameter rod 72, having a diameter lesser than that of the upper and lower portion 66, 68, spans the gap 70 to connect the upper and lower portions 66, 68. A capacitor 74 can couple across the gap 70 at the rod 72. A fastener aperture 78 can be formed in the lower portion 68, adapted to couple to the second connector 22 of FIG. 1.

With the capacitor 74, the small-diameter rod 72 forms an inductor 76, defining a parallel-tuned tank circuit as the trap 64. The trap 64 can operate at a Q-factor representative of how underdamped the second antenna 60 is by the trap 64, where:

$$Q = \frac{1}{R}\sqrt{\frac{L}{C}} \tag{1}$$

where R is the resistance, L is the inductance, and C is the capacitance. The Q-factor for the trap 64 should be high and maximized, and can be tailored so that a resulting VSWR for the monopole antenna 62 at about 1575 MHz is high enough to eliminate or reduce the current in the upper portion 66 of the monopole antenna 62. Providing a silver plating for the monopole antenna 62 can increase the Q-factor for the trap 64 by increasing surface conductivity for the monopole antenna 62. For example, the VSWR in the frequency range of about 1575 MHz should be at least 10:1, and can be greater. The Q-factor of the trap 64, therefore, should be high enough to produce a VSWR of at least 10:1 at about 1575 MHz, while operating at 2:1 or less within the 960-1220 MHz frequency range. This provides for preventing the second antenna 60 from affecting the gain and radiation patterns of the first antenna 40. Such types of affected interference can be minimized or eliminated with the use of the trap 64.

Figure 6:
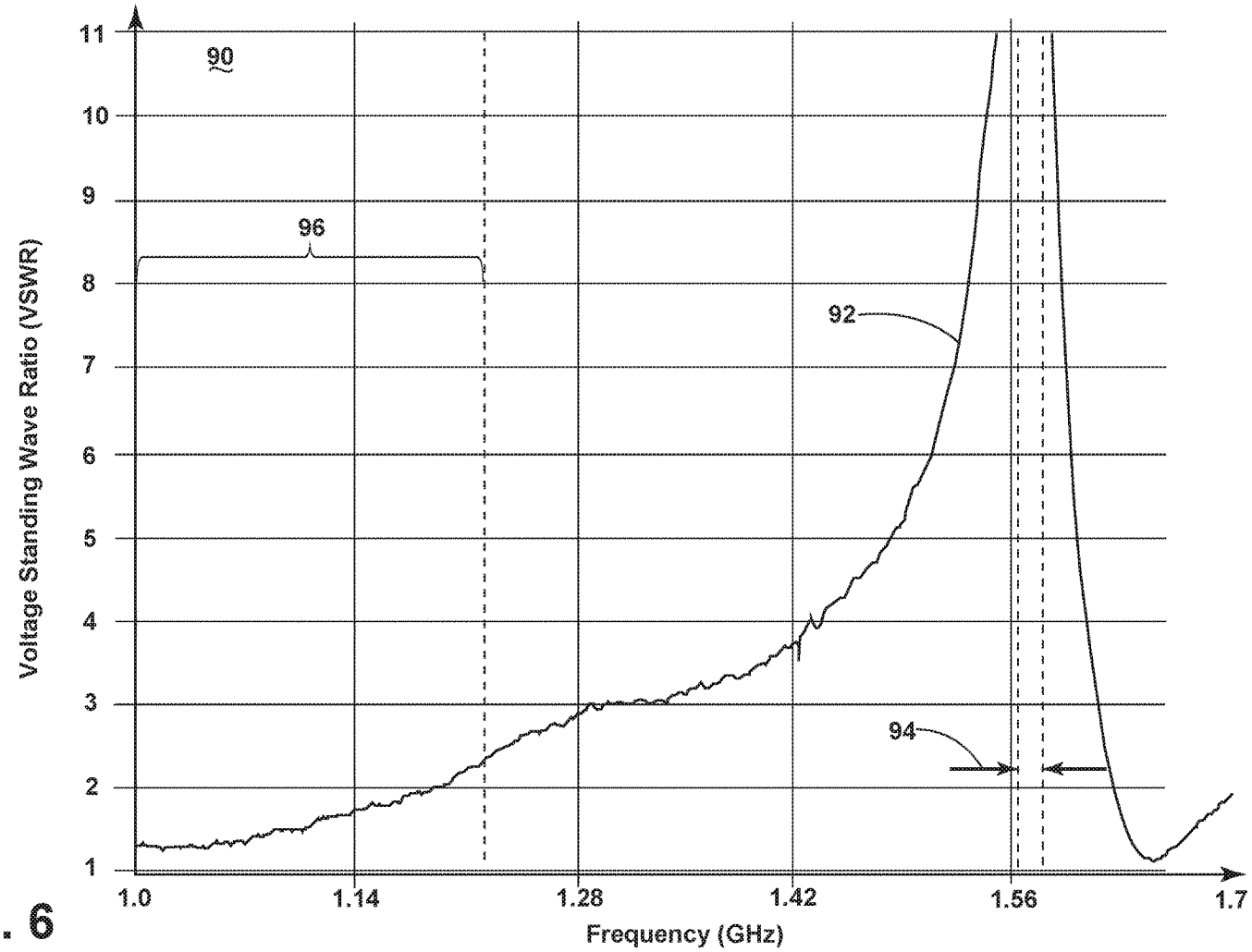
FIG. 6 is a graph illustrating a first plot of voltage standing wave ratio over frequency for the monopole antenna of FIG. 5.

Referring now to FIG. 6, a graph 90 includes a plot 92 illustrating the VSWR for the monopole antenna 62 against frequency from 1000 MHz (1.0 GHz) to 1700 MHz (1.7 GHz), as caused by the trap 64. The first antenna 40 of FIG. 4 operates at about 1575 MHz and is illustrated as a first range 94 and the second antenna 60 is resonant from about 960 MHz to 1220 MHz, and is illustrated as a second range 96. It should be appreciated that the trap 64 does not eliminate or reduce current at the frequency of the second antenna 60, having a VSWR of about 2.5 or less within the second range 96. However, the trap 64 eliminates or reduces a significant amount of current within the operational range of the first antenna 40, having a VSWR of greater than 10 from about 1540 MHz to 1590 MHz, covering the range of the first antenna 40. Therefore, the trap 64 eliminates interference with the first antenna 40 otherwise caused by the second antenna 60.

It should be appreciated that the trap 64 when utilized with the second antenna 60 can minimize signal loss of the first antenna 40 caused by the second antenna 60. As such, a first antenna 40 and a second antenna 60 can be utilized within close proximity of one another. Only a single assembly 10 and housing 12 are required to contain both antennas 40, 60, as opposed to requiring two assemblies, with physical separation between the two. Therefore, a cost savings can be realized, as well as a reduction in weight and overall aerodynamic drag in aircraft implementations, which can reduce specific fuel consumption.

Figure 7:
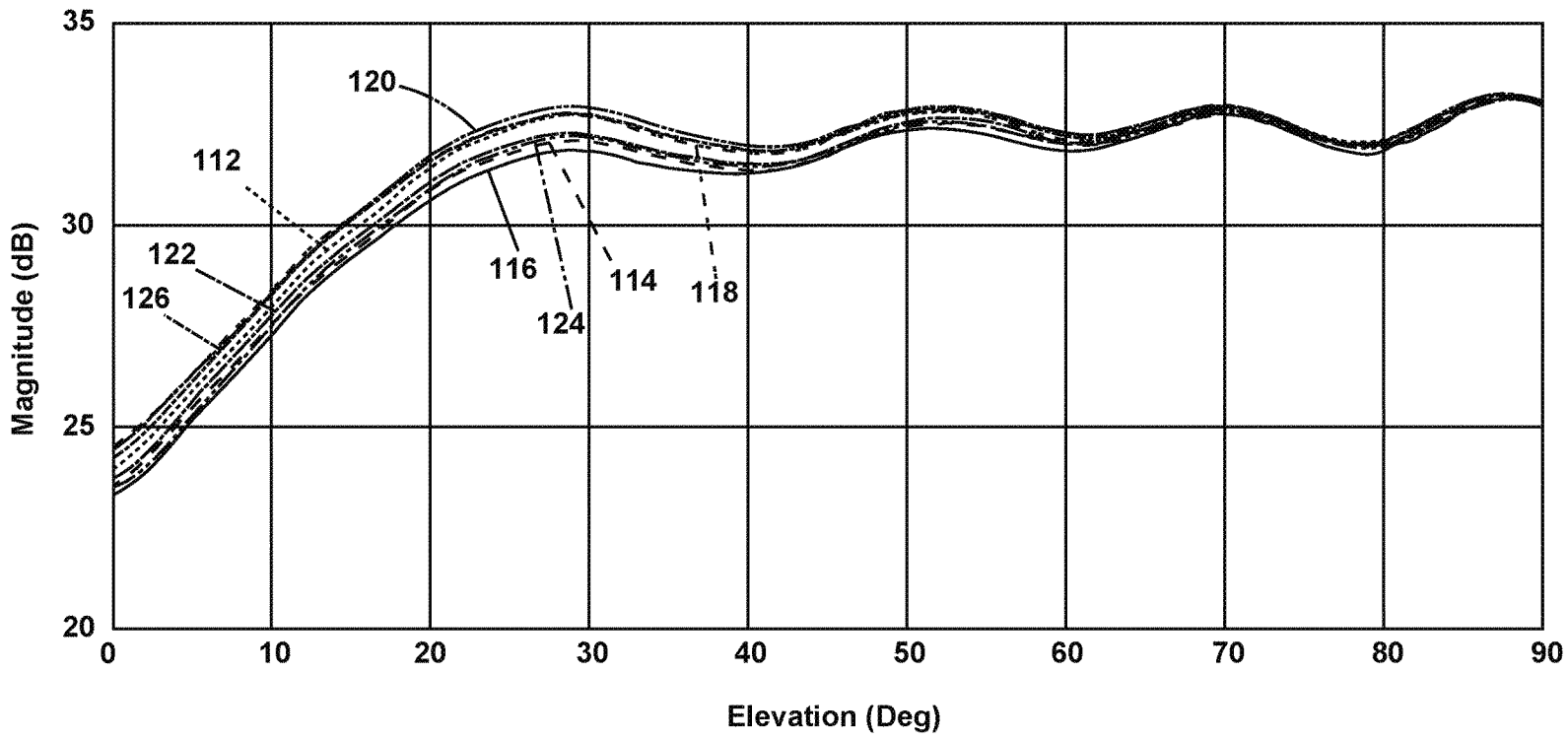
FIG. 7 is another graph illustrating 8 different azimuth angle plots for the GPS antenna without an L-band monopole present within the housing, plotted as Magnitude vs Elevation.

Referring now to FIG. 7, a first elevation response graph 110 illustrates magnitude (dB) along the elevation (deg) for the first antenna 40 operating at about 1575 MHz, when used alone, without operation of the second antenna 60. The graph 106 includes eight plots at eight different azimuth angles, relative to the ground plate 14 of FIG. 4. A first plot 112 is arranged at an azimuth angle of −135 degrees, a second plot 114 is arranged at −90 degrees, a third plot 116 is arranged at −45 degrees, a fourth plot 118 is arranged at 0 degrees, a fifth plot 120 is arranged at 45 degrees, a sixth plot 122 is arranged at 90 degrees, a seventh plot 124 is arranged at 135 degrees, and an eighth plot 126 is arranged at 180 degrees. As is appreciable, the plots 112-126 are arranged in a tight grouping, representing a consistent operation for the first antenna 40 when operating alone.

Figure 8:
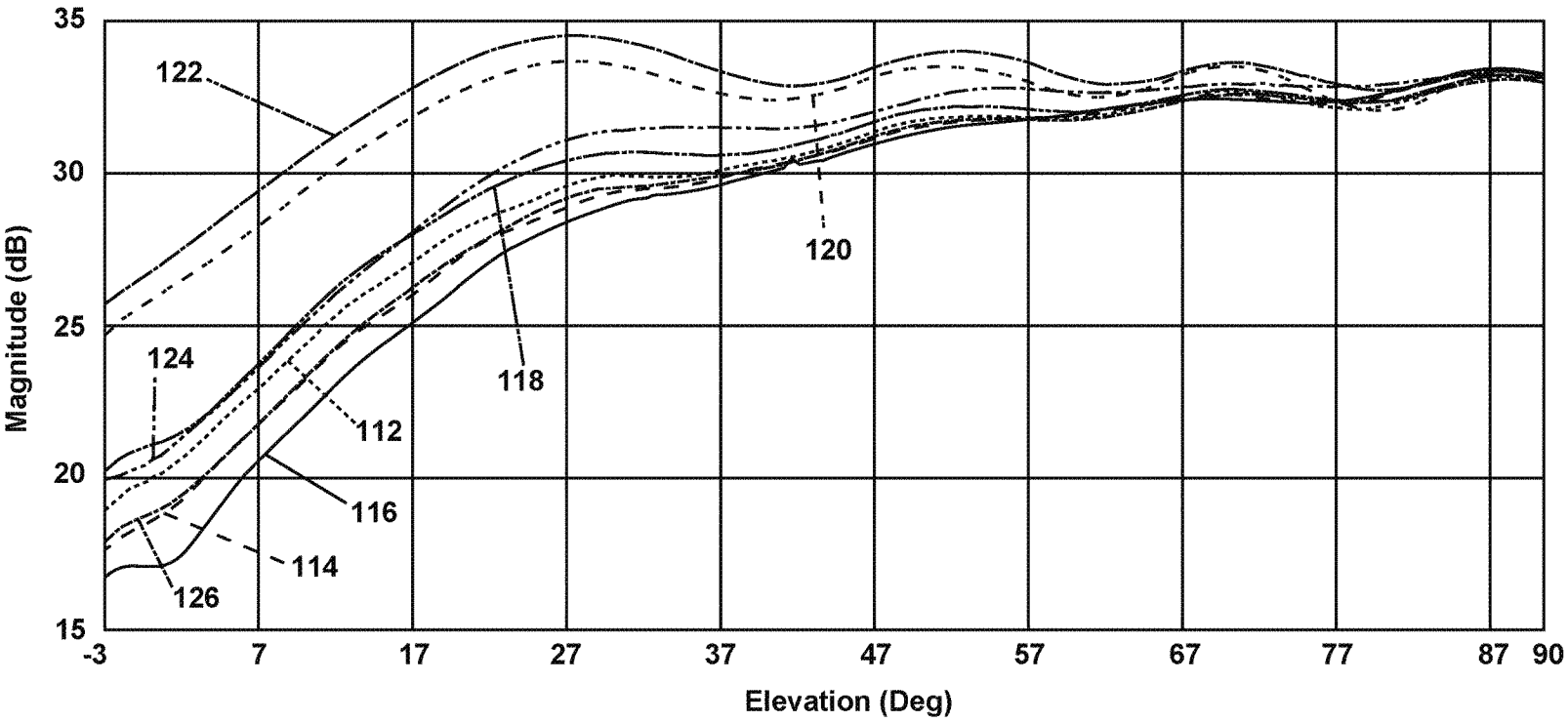
FIG. 8 is yet another graph illustrating 8 different azimuth angle plots for the GPS antenna of FIG. 4 when operating in combination with the monopole antennal plotted as Magnitude vs Elevation.

Referring now to FIG. 8, a second elevation response graph 130 illustrates magnitude (dB) along the elevation (deg) for the first antenna 40 operating at about 1575 MHz, when used in combination with and adjacent to the second antenna 60, without the benefit of the trap 64. It should be appreciated that this plot is used for reference alone in order to appreciate the resultant benefit of utilizing the trap 64. The same eight plots 112-126 are arranged at the same azimuth angle values as that of FIG. 7. As is appreciable, when utilizing the second antenna 60 with the first antenna 40, the elevation responses are no longer tightly grouped, and can have significant variation. Particularly, the plot 122 at the 90 degrees azimuth angle and the plot 120 at the 45 degrees azimuth angle are have about a 25% variation at about 0-degrees elevation decreasing as the elevation increases, and there is measurable variation among the responses at the remaining azimuth angles. Furthermore, it should be appreciated that there is an overall decrease in magnitude (dB) for the first antenna 40. Such variation is representative of the signal loss generated by use of the second antenna 60, which affects the gain and radiation patterns of the first antenna 40. Such variation can result in operation of the first antenna 40 that falls outside of federal aviation administration technical standard orders (FAA TSO), required to be met when the antenna assembly 10 is used in an aircraft implementation.

Figure 9:
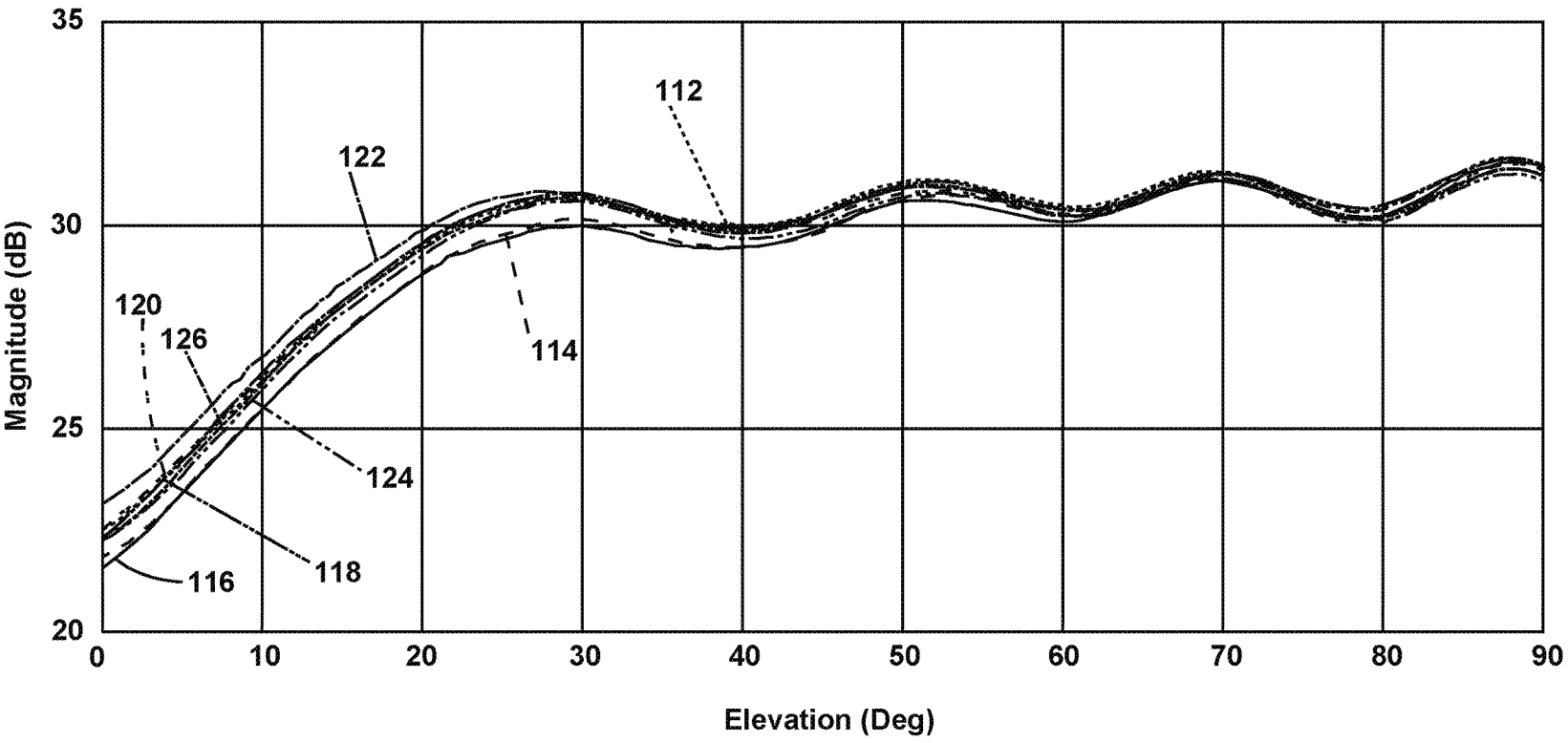
FIG. 9 is yet another graph illustrating 8 different azimuth angle plots for the GPS antenna of FIG. 4 when operating in combination with the monopole antenna utilizing the trap.

Referring now to FIG. 9, a third elevation response graph 132 illustrates magnitude (dB) along the elevation (deg) for the first antenna 40 when operating at about 1575 MHz, when used in combination with and adjacent to the second antenna 60, having the benefit of the trap 64, such as that shown in FIG. 4. The same eight plots 112-126 are arranged at the same azimuth angle values as that of FIGS. 7 and 8. As is appreciable, when compared with that of FIGS. 7 and 8, the elevation responses are again tightly grouped, as well as having an improved magnitude (dB) relative to FIG. 8. Therefore, it should be appreciated that utilizing the trap 64 with the second antenna 60 can minimize or eliminate the effect of the second antenna 60 on the first antenna 40, minimizing an impact on the gain and radiation patterns of the first antenna 40. The resultant operation of the first antenna 40 can fall within FAA TSO requirements, as opposed to that when the second antenna 60 is used without the trap.

Figure 10:
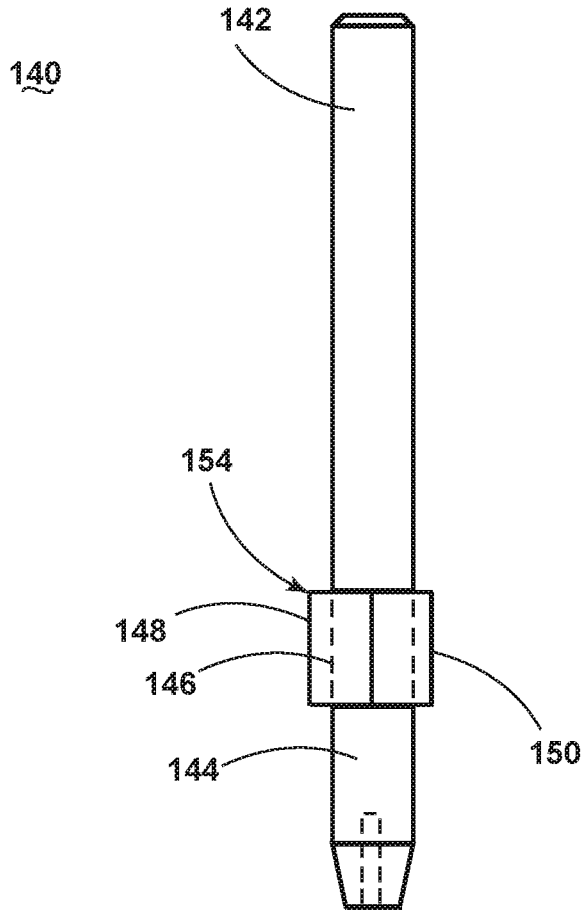
FIG. 10 is a view of an alternative exemplary monopole antenna.

Referring now to FIG. 10, an alternative monopole antenna 140 is illustrated, having a top portion 142 and a bottom portion 144 of the monopole antenna 140. An insulator 146 couples the top portion 142 to the bottom portion 144. A trap 154 can include an inductor 148 and a capacitor 150. The inductors 148 can be coil-type inductors, for example, and can be soldered to the insulator 146. The capacitor 150 can be coupled to the second inductor 148. The inductor 148 and the capacitor 150 should be arranged in parallel, between the top portion 142 and the bottom portion 144. The trap 154 can be tuned to prevent signal loss at a particular frequency at an external antenna to the monopole antenna 140, such as the GPS antenna 40 of FIG. 4.

It should be appreciated that while illustrating the exterior of the insulator 146, the inductor 148 and the capacitor 150 can be arranged internal of the insulator 146. It should be further appreciated that the disclosure should not be limited to the two exemplary monopole antennae 60, 140 as described. Any suitable antenna or monopole antenna utilizing an inductor and a capacitor or similar electrical circuit to form a trap can be utilized, in order to minimize signal loss of one antenna caused by the antenna with the trap. Therefore, it should be appreciated that a myriad or geometries and organizations for the trap with one or more antennas is contemplated.

To the extent not already described, the different features and structures of the various embodiments can be used in combination, or in substitution with each other as desired. That one feature is not illustrated in all of the embodiments is not meant to be construed that it cannot be so illustrated, but is done for brevity of description. Thus, the various features of the different embodiments can be mixed and matched as desired to form new embodiments, whether or not the new embodiments are expressly described. All combinations or permutations of features described herein are covered by this disclosure.

This written description uses examples to describe aspects of the disclosure described herein, including the best mode, and also to enable any person skilled in the art to practice aspects of the disclosure, including making and using any devices or systems and performing any incorporated methods. The patentable scope of aspects of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. An antenna assembly for an aircraft comprising:

a housing defining an interior and including a bottom forming a ground plane;

a WAAS GPS antenna mounted within the interior and operating at a first frequency;

an L-band monopole antenna mounted within the interior and extending from the ground plane comprising an upper portion and a lower portion separated by a gap; and a conductive rod having a decreased diameter coupled at a first end to the upper portion, and coupled at a second opposing end to the lower portion; and a trap comprising a parallel-tuned tank circuit including an inductor and a capacitor, coupled to the L-band monopole antenna and tuned to the first frequency of the WAAS GPS antenna;

wherein the trap operates to prevent the L-band monopole antenna from affecting gain and radiation patterns of the WAAS GPS antenna at the first frequency;

wherein the rod forms the inductor for the trap; and wherein the ground plane comprises a first fastener, the lower portion of the L-band monopole antenna comprises a second fastener coupleable to the first fastener, and wherein the lower portion of the L-band monopole antenna is coupled to the ground plane via the first and second fasteners.

2. The antenna assembly of claim 1 wherein the first frequency is about 1575 MHz.

3. The antenna assembly of claim 1 wherein the L-band monopole antenna operates in a frequency range between 1 GHz and 1.2 GHz.

4. The antenna assembly of claim 1 wherein the trap is tuned to about 1575 MHz.

5. The antenna assembly of claim 1 wherein the ground plane is a common ground plane to both the WAAS GPS antenna and the L-band monopole antenna.

6. The antenna assembly of claim 1 wherein the L-band monopole antenna is coated in Silver.

7. The antenna assembly of claim 1, wherein the capacitor is provided at the rod, to form the trap with the inductor.

8. The antenna assembly of claim 1 wherein the trap provides for a voltage standing wave ratio of at least 10:1 at about 1575 MHz frequency.

9. An antenna assembly for an aircraft comprising:

a housing defining an interior;

a first antenna mounted within the interior and operating at a first frequency;

a monopole antenna mounted within the interior, comprising an upper portion and a lower portion separated by a gap; a conductive rod having a decreased diameter coupled at a first end to the upper portion, and coupled at a second opposing end to the lower portion; and an electronic trap comprising a parallel-tuned tank circuit coupled to the monopole antenna and tuned to the first frequency of the first antenna;

wherein the trap operates to prevent the monopole antenna from affecting gain and radiation patterns of the first antenna at the first frequency and wherein the rod forms an inductor for the trap.

10. The antenna assembly of claim 9 wherein the first frequency is about 1575 MHz.

11. The antenna assembly of claim 9 wherein the monopole antenna operates in a frequency range between 1 GHz and 1.2 GHz.

12. The antenna assembly of claim 9 wherein the parallel-tuned tank circuit includes the inductor and a capacitor.

13. The antenna assembly of claim 9 further comprising a ground plate enclosing the interior, wherein the ground plate is common to both the first antenna and the monopole antenna.

14. The antenna assembly of claim 13, wherein the ground plate comprises a first fastener, the monopole antenna comprises a second fastener, and wherein the monopole antenna is coupled to the ground plate via the first and second fasteners.

15. A dual function antenna comprising a WAAS GPS antenna and an L-band monopole antenna coupled to a common ground plate, and including a trap comprising a parallel-tuned tank circuit coupled to the L-band monopole antenna to prevent the L-band monopole antenna from affecting gain and radiation patterns of the WAAS GPS antenna;

wherein the ground plate comprises a first fastener, the L-band monopole antenna comprises a second fastener coupleable to the first fastener, and wherein the L-band monopole antenna is coupled to the ground plate via the first and second fasteners.

16. The dual function antenna of claim 15 wherein the WAAS GPS antenna operates a frequency of about 1575 MHz and the trap is tuned to about 1575 MHz.

17. The dual function antenna of claim 15 wherein the L-band monopole antenna can operate as any of a transponder, an ADS-B, or a DME.

* * * * *